US007458832B2

(12) United States Patent
Shibata

(10) Patent No.: US 7,458,832 B2
(45) Date of Patent: Dec. 2, 2008

(54) CONNECTOR

(75) Inventor: Takahiro Shibata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/954,655

(22) Filed: Dec. 12, 2007

(65) Prior Publication Data

US 2008/0146070 A1 Jun. 19, 2008

(30) Foreign Application Priority Data

Dec. 15, 2006 (JP) ..... 2006-337800

(51) Int. Cl.
*H01R 13/62* (2006.01)

(52) U.S. Cl. ..... 439/157; 439/160

(58) Field of Classification Search ..... 439/141, 439/157, 160

See application file for complete search history.

(56) References Cited

U.S. PATENT DOCUMENTS 6,095,833 A 8/2000 Osawa
6,544,054 B2 * 4/2003 Ishikawa et al. ..... 439/157

* cited by examiner

*Primary Examiner*—Tho D Ta
*Assistant Examiner*—Travis Chambers
(74) *Attorney, Agent, or Firm*—Gerald E. Hespos; Anthony J. Casella

(57) ABSTRACT

A moving plate (40) is formed such that a wall (42) projects forward from a plate-like main body (41). Since the wall (42) surrounds only tabs (31C) located near the center of a receptacle (12) and crosses the inside of the receptacle (12) instead of extending along the inner periphery of the receptacle (12). Accordingly, even if an attempt is made to insert a female connector (50) in an oblique posture into the receptacle (12), the female connector (50) cannot be inserted deeply into the receptacle (12) due to interference with the wall (42), and the damage of the tabs (31A, 31B) and (31C) by the female connector (50) can be prevented.

14 Claims, 10 Drawing Sheets

CONNECTOR

BACKGROUND OF THE INVENTION

1. Field of the Invention

The invention relates to a connector.

2. Description of the Related Art

U.S. Pat. No. 6,095,833 discloses a connector with a male housing formed with a receptacle. Male terminal fittings are mounted in the male housing and have tabs that project into the receptacle. A moving plate is provided in the receptacle of the male housing and is moved forward and backward by a lever. The moving plate includes a plate-like main body, through which the tabs of the male terminal fittings project. A wall stands up from the peripheral edge of the main body, and extends along the inner peripheral surface of the receptacle.

A mating connector can be fit into the receptacle in an oblique posture. Thus, a corner of the mating connector located at the front end with respect to an inserting direction might contact the tabs to damage the tabs.

The invention was developed in view of the above situation and an object thereof is to prevent the damage of tabs by a mating connector.

SUMMARY OF THE INVENTION

The invention relates to a connector that comprises a housing formed with a receptacle for receiving a mating connector. The connector also includes male terminal fittings with tabs. The tabs project forward into the receptacle. At least one moving plate is disposed in the receptacle for aligning the tabs. The moving plate is movable in the receptacle between a position close to an opening of the receptacle and a position at the back of the receptacle. The moving plate preferably is integral or unitary with the main body through which the tabs are passed. A wall projects from the main body and at least partly surrounds only some of the tabs. Thus, the wall may cross the inside of the receptacle or may be located at a position at or near the center of the receptacle instead of extending along the inner peripheral surface of the receptacle. Accordingly, even if an attempt is made to insert the mating connector into the receptacle in an oblique posture, the mating connector will interfere with the wall and cannot be inserted deeply into the receptacle. Therefore the mating connector cannot damage the tabs.

The movable member preferably is configured to display a cam action for assisting a connection of the connector with the mating connector and/or for displacing the moving plate.

The movable member preferably positions the moving plate close to the opening of the receptacle before the mating connector is fit in the receptacle. Thus, the front end edge of the wall is more forward than the front ends of the tabs so that the mating connector cannot damage the tabs.

The mating connector preferably has grooves for avoiding interference with the wall. The moving plate can be moved to the back side of the receptacle by operating the movable member. Thus, the depth of the grooves of the mating connector can be decreased as compared to a construction in which a wall projects fixedly from the back end surface of the receptacle. Accordingly, the grooves do not significantly decrease the rigidity of the mating connector.

The main body preferably is smaller than an opening area of the receptacle. Thus, the main body has high flexion rigidity and is difficult to deform even if being thinned. The main body can be thinned to achieve miniaturization.

Some of the tabs preferably pass through the main body.

The wall preferably is formed along the periphery of the main body.

The opening of the receptacle preferably is substantially rectangular.

The moving plate preferably is at or near a longitudinal center of the opening of the receptacle. Thus, variations in the widths of spaces partitioned by the wall in the receptacle become smaller. In other words, damage of the tabs by the mating connector is prevented more reliably since there is no very wide space.

The wall preferably divides an internal space of the receptacle into a plurality of spaces.

The wall preferably is substantially parallel with a projecting direction of the tabs.

The wall preferably is formed with cutouts so that even if the wall is curved and deformed, the tabs other than the tabs at least partly surrounded by the wall can at enter the cutouts.

The tabs preferably comprise at least two types of tabs, and the smaller tabs are positioned by the moving plate.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
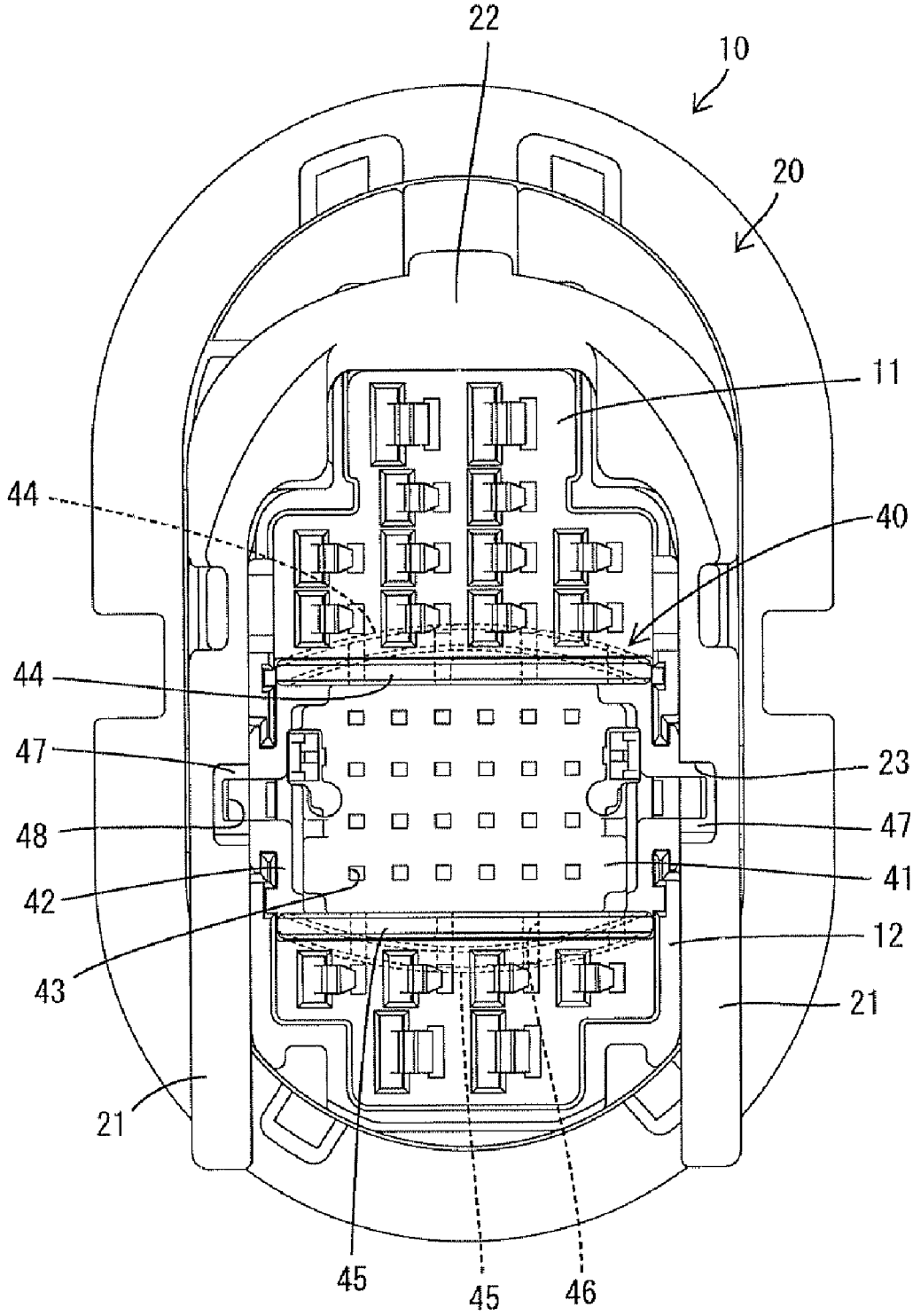
FIG. 1 is a front view of one preferred embodiment.
Figure 2:
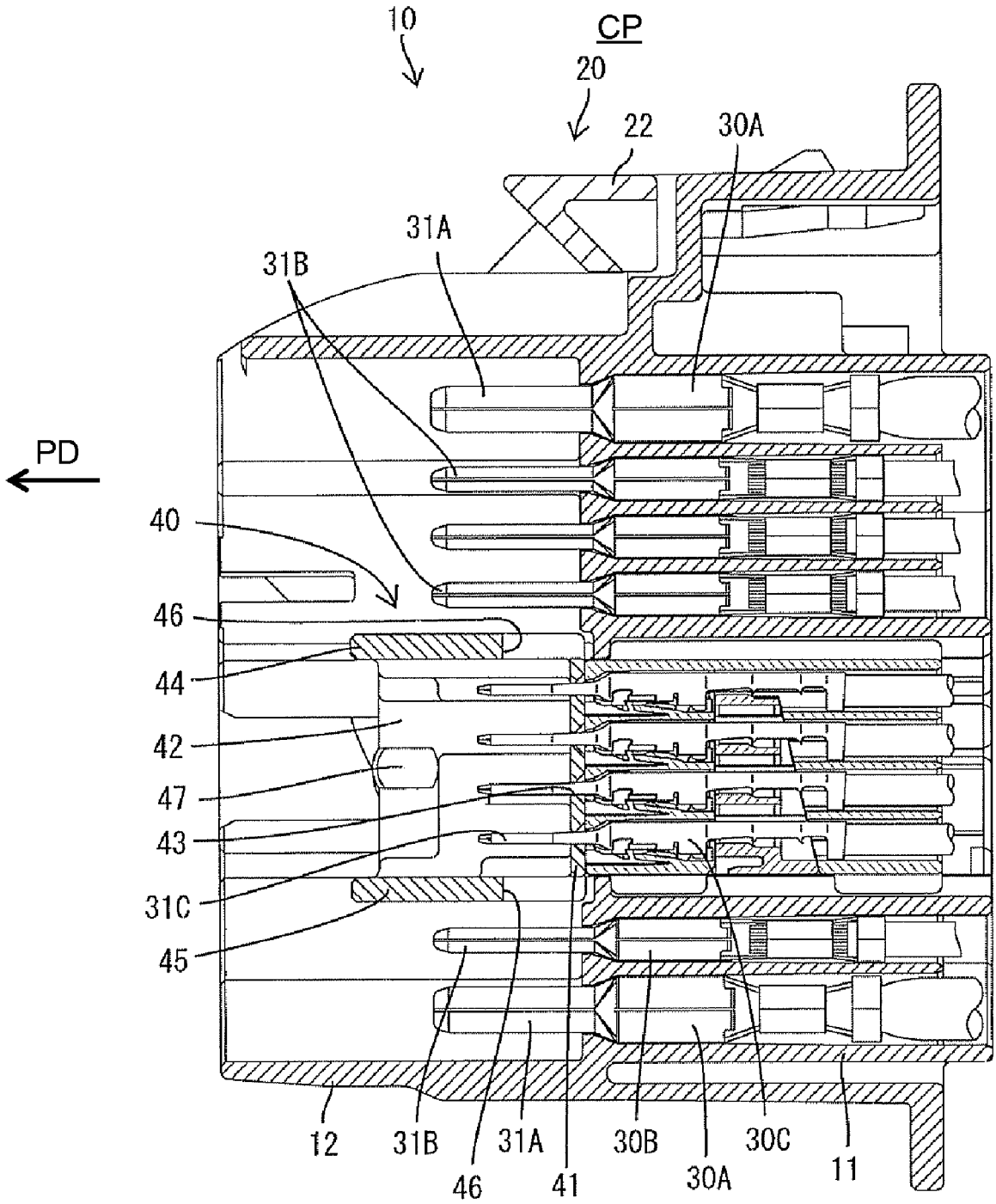
FIG. 2 is a vertical section showing a state where a moving plate is at a retracted position.
Figure 3:
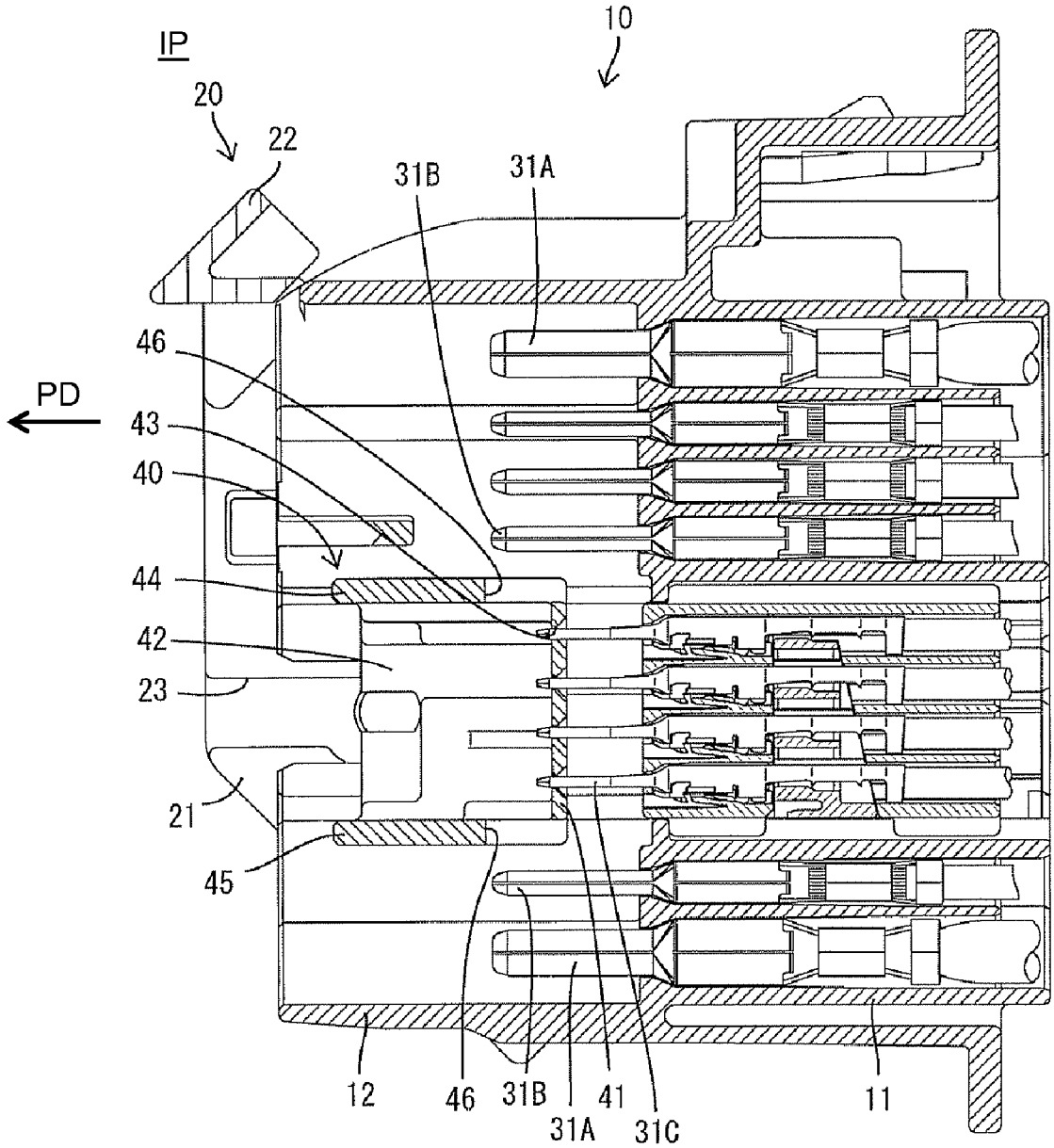
FIG. 3 is a vertical section showing a state where the moving plate is at an advanced position.

A male connector 10 in accordance with the invention is identified by the numeral 10 in FIGS. 1 to 5. The male connector 10 has a housing 11 made e.g. of synthetic resin, a movable member such as a lever 20 likewise made e.g. of synthetic resin, one or more, preferably a plurality of male terminal fittings 30A, 30B and 30C and a moving plate 40 made e.g. of synthetic resin. The movable member can be operated so as to display a cam action to connect the male connector housing 10 with a female connector 50.

The housing 11 is a vertically long block and includes a forwardly projecting receptacle 12. The receptacle 12 has a vertically long rectangular opening. However, middle parts of the upper and lower shorter sides project out to form horizontally long rectangular sections. The opposite left and right plates of the receptacle 12 are formed with escaping grooves 13 in the form of slits that extend back from the front end of the receptacle 12.

The connector 10 also includes a lever 20 with two plate-shaped arms 21 that extend along the outer left and right surfaces of the housing 11 and a curved operable portion 22 that extends unitarily between the ends of the arms 21. Cam grooves 23 are formed in the surfaces of the arms 21 facing the housing 11, and bearing holes in the arms 21 are engaged with corresponding supporting shafts 14 on the outer side surfaces of the housing 11. Thus, the lever 20 is rotatable on the housing 11 between an initial position IP where the entrances of the cam grooves 23 face the escaping grooves 13 (see FIG. 3) and a connection position CP where the operable portion 22 is displaced backward (see FIG. 2).

Three types of male terminal fittings 30A, 30B and 30C having different sizes and/or configurations are inserted into the housing 11 from behind. Long narrow tabs 31A, 31B and 31C are formed at the front ends of the male terminal fittings 30A, 30B and 30C and project forward from the back end of the receptacle 12. The tabs 31A, 31B and 31C are arrayed vertically and transversely in the receptacle 12 and are surrounded by the receptacle 12. The first tabs 31A are the largest and are arranged at uppermost and bottom positions. The third tabs 31C are the smallest and are arranged at positions slightly displaced down from the vertical center. The second tabs 31B have a medium size and are arranged between the first and second types of tabs 31A, 31C. The projecting distances of the first and second tabs 31A, 31B from the back end surface of the receptacle 12 are substantially equal, and the projecting distance of the third tabs 31C is shorter.

The moving plate 40 includes a plate-shaped main body 41 aligned substantially at a right angle to the projecting direction PD of the tabs 31A, 31B and 31C and a surrounding wall 42 that is unitary with the main body 41. The surrounding wall 42 projects unitarily forward from the entire peripheral edge of the main body 41 to form a substantially rectangular tube. The vertical dimension of the moving plate 40 is smaller than the vertical dimension of the opening of the receptacle 12. However, the transverse dimension of the moving plate 40 is substantially equal to or slightly smaller than the transverse dimension of the opening of the receptacle 12. In other words, the moving plate 40 is smaller than the opening of the receptacle 12. Further, the vertical position of the moving plate 40 is displaced lower than the center of the receptacle 12 and corresponds to the area of the small third tabs 31C. Thus, the first and second tabs 31A, 31B are arranged in areas outside the moving plate 40. Positioning holes 43 penetrate the main body 41 in forward and backward directions. All of the third tabs 31C are passed through the respective positioning holes 43.

The surrounding wall 42 includes an upper wall 44 and a lower wall 45 that are substantially horizontal flat plates aligned substantially parallel with the projecting direction PD of the tabs 31A, 31B and 31C. The upper and lower walls 44, 45 partition the internal space of the receptacle 12 into three spaces, namely, a space enclosed by the surrounding wall 42 of the moving plate 40, a space above the moving plate 40 and a space below the moving plate 40. The upper and lower walls 44, 45 are formed with cutouts 46 that extend substantially forward and parallel with the tabs 31A, 31B and 31C from the rear surface of the main body 41. The cutouts 46 of the upper wall 44 preferably are in the form of slits substantially corresponding to the second tabs 31B located above and adjacent to the upper wall 44, whereas the cutouts 46 of the lower wall 45 are in the form of slits substantially corresponding to the second tabs 31B located below and adjacent to the lower wall 45. The width of the cutouts 46 in the transverse direction is slightly larger than the transverse dimension of the second tabs 31B. The front ends of the cutouts 46 are slightly before the front ends of the second tabs 31B when the moving plate 40 is at an advanced position. Further, the cutouts 46 penetrate the upper and lower walls 44, 45 from the outer surfaces to the inner surfaces.

Cam followers 47 project respectively from the outer surfaces of the left and right walls of the surrounding wall 42. Each cam follower 47 has a recess 48 with an open front for receiving a corresponding cam pin (not shown) of the female connector 50. The cam followers 47 can be fit into the cam grooves 23 of the lever 20 through the escaping grooves 13 of the receptacle 12. Rotation of the lever 20 generates a cam action between the cam followers 47 and the cam grooves 23 and causes the moving plate 40 to move forward and backward substantially along the projecting direction PD. Specifically, the moving plate 40 is at the advanced position close to the open front end of the receptacle 12 when the lever 20 is at the initial position IP. The moving plate 40 is moved towards the back side of the receptacle 12 as the lever 20 is rotated towards the connection position CP. The moving plate 40 is at a retracted position when the lever 20 reaches the connection position CP. The positioning holes 43 engage the leading ends of the third tabs 31C and the rear surface of the main body 41 is spaced forward from the back end surface of the receptacle 12 when the moving plate 40 is at the advanced position. On the other hand, the positioning holes 43 engage the base ends of the third tabs 31C and the main body 41 is substantially at the back end surface of the receptacle 12 with the moving plate 40 at the retracted position.

The female connector 50 is a vertically long block as a whole, and three types of female terminal fittings 51A, 51B and 51C having sizes and/or configurations in conformity with the male terminal fittings 30A, 30B and 30C are accommodated therein. The female connector 50 is formed with upper and lower grooves 52 extending substantially back from the front end surface of the female connector 50. The grooves 52 are provided to avoid interference with the upper and lower walls 44, 45 of the moving plate 40 and define slits crossing between the opposite left and right surfaces of the female connector 50. The female connector 50 is divided into upper, middle and lower terminal holding portions 53 by the upper and lower grooves 52, and the terminal holding portions 53 are connected by a connecting portion 54 at the rear ends thereof. Cam pins (not shown) having a known shape project from the left and right surfaces of the female connector 50.

Upon connecting the female connector 50 and the male connector 10, the female connector 50 is fit lightly into the receptacle 12 while the cam pins are moved in the escaping grooves 13 with the operable lever 20 located at the initial position IP and the moving plate 40 located at the advanced position. The cam pins are fit into the recesses 48 of the cam followers 47 and wait on standby near the entrances of the cam grooves 23. The cam pins then are united with the cam followers 47 and engage with the cam grooves 23. Further, the terminal holding portion 53 of the female connector 50 between the upper and lower grooves 52 is fit into the space surrounded by the surrounded wall 42 of the moving plate 40, and the upper and lower walls 44, 45 of the moving plate 40 are fit respectively into the upper and lower grooves 52 of the female connector 50. The lever 20 then is rotated towards the connection position CP. As a result, the moving plate 40 and the female connector 50 become integral to each other and are pulled toward the back side of the receptacle 12 by the cam action caused by the engagement of the cam pins, the cam followers 47 and the cam grooves 23 so that the two connectors are properly connected. The small third tabs 31C are kept in a specified arrayed state by the main body 41 during this connecting operation. Thus, the third tabs 31C enter the female connector 50 and connect reliably with the small third female terminal fittings 51C.

The lever 20 is rotated from the connection position CP towards the initial position IP to separate the two connectors 10, 50. As a result, the cam action causes the interengaged moving plate 40 and female connector 50 to move forward of the receptacle 12. The female connector 50 then can be pulled so that the cam pins disengage from the cam followers 47 and the female connector 50 can be separated from the receptacle 12. The lever 20 is held at the initial position IP with the female connector 50 detached, and the moving plate 40 is held at the advanced position.

Figure 4:
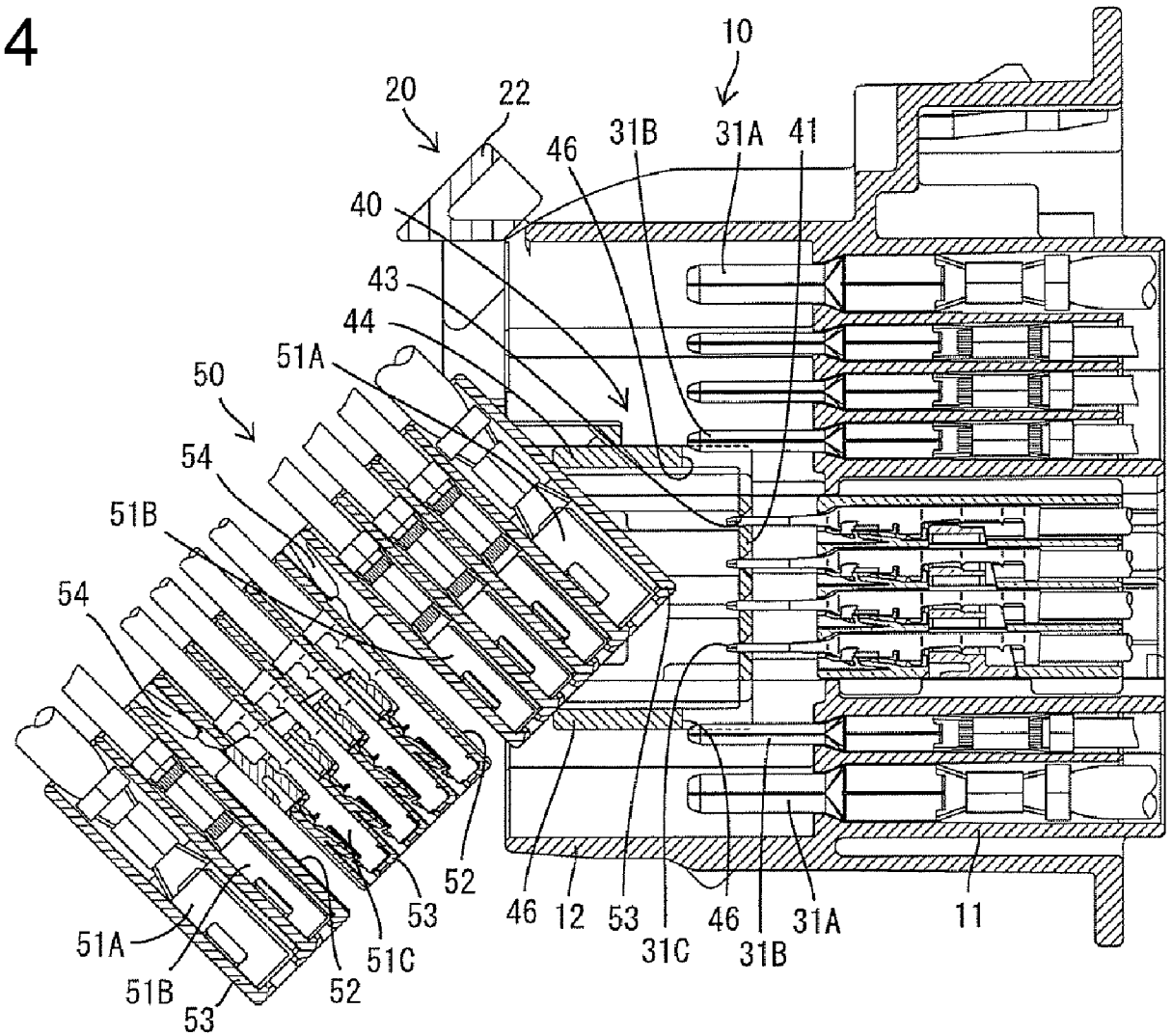
FIG. 4 is a vertical section showing a state where a female connector is being inserted in an oblique posture into a receptacle.
Figure 5:
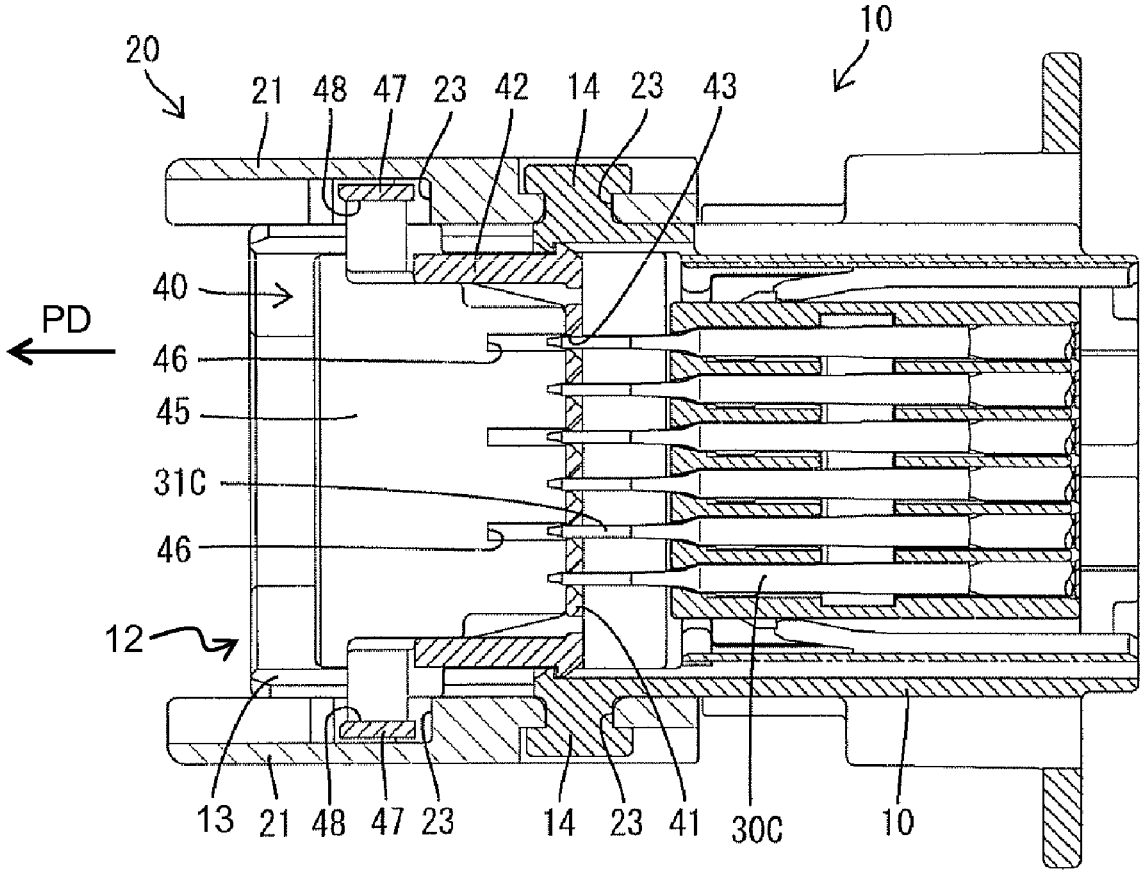
FIG. 5 is a horizontal section showing a state where the moving plate is at the advanced position.
Figure 6:
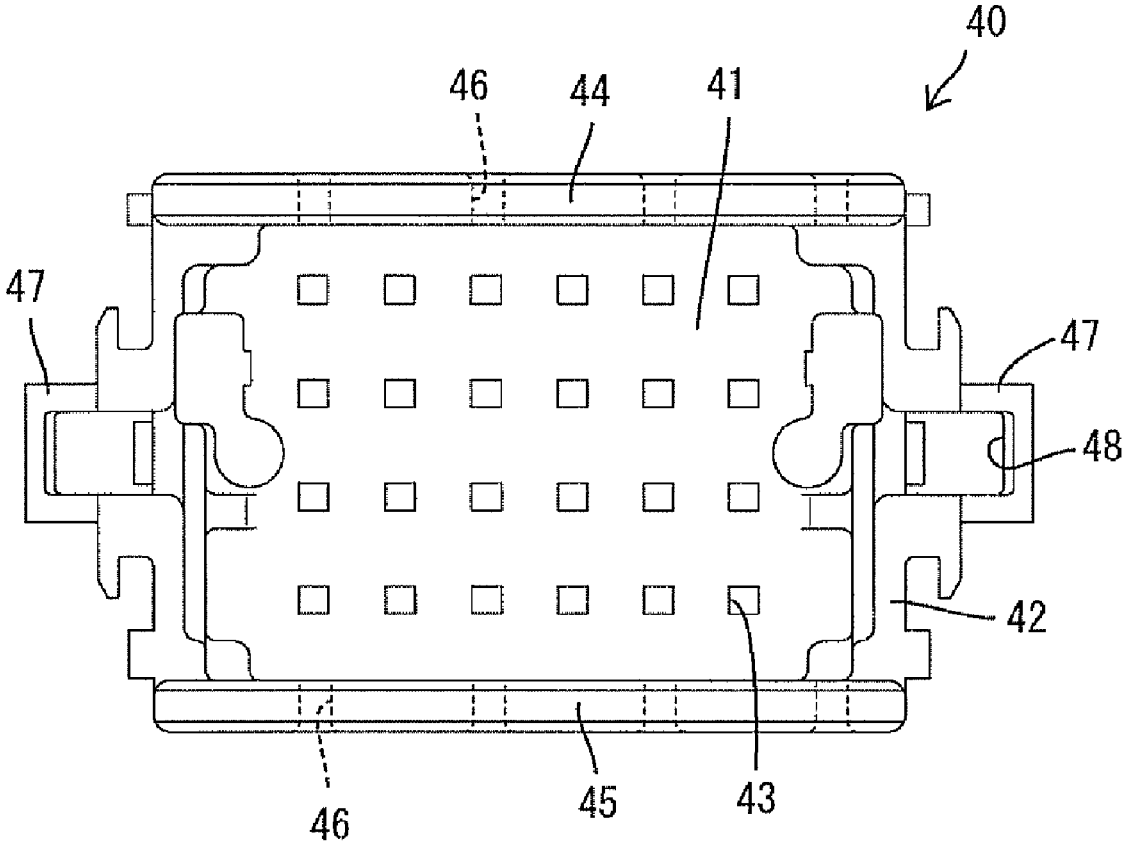
FIG. 6 is a front view of the moving plate.
Figure 7:
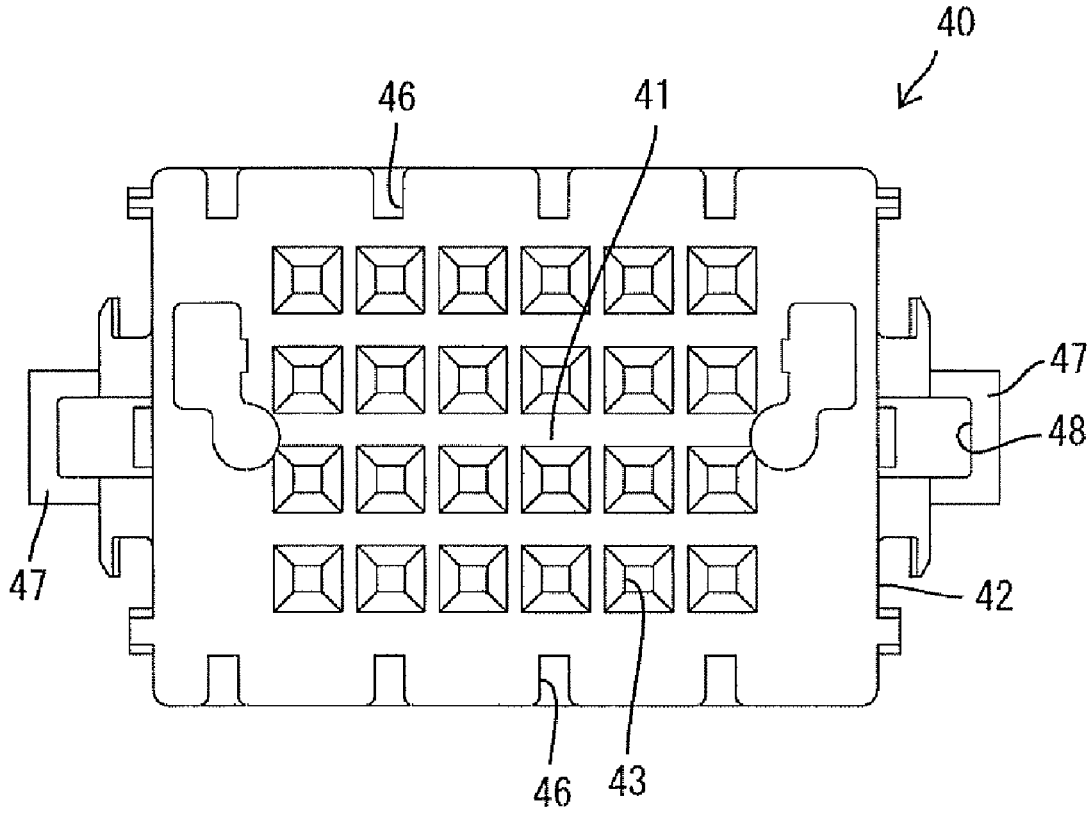
FIG. 7 is a rear view of the moving plate.
Figure 8:
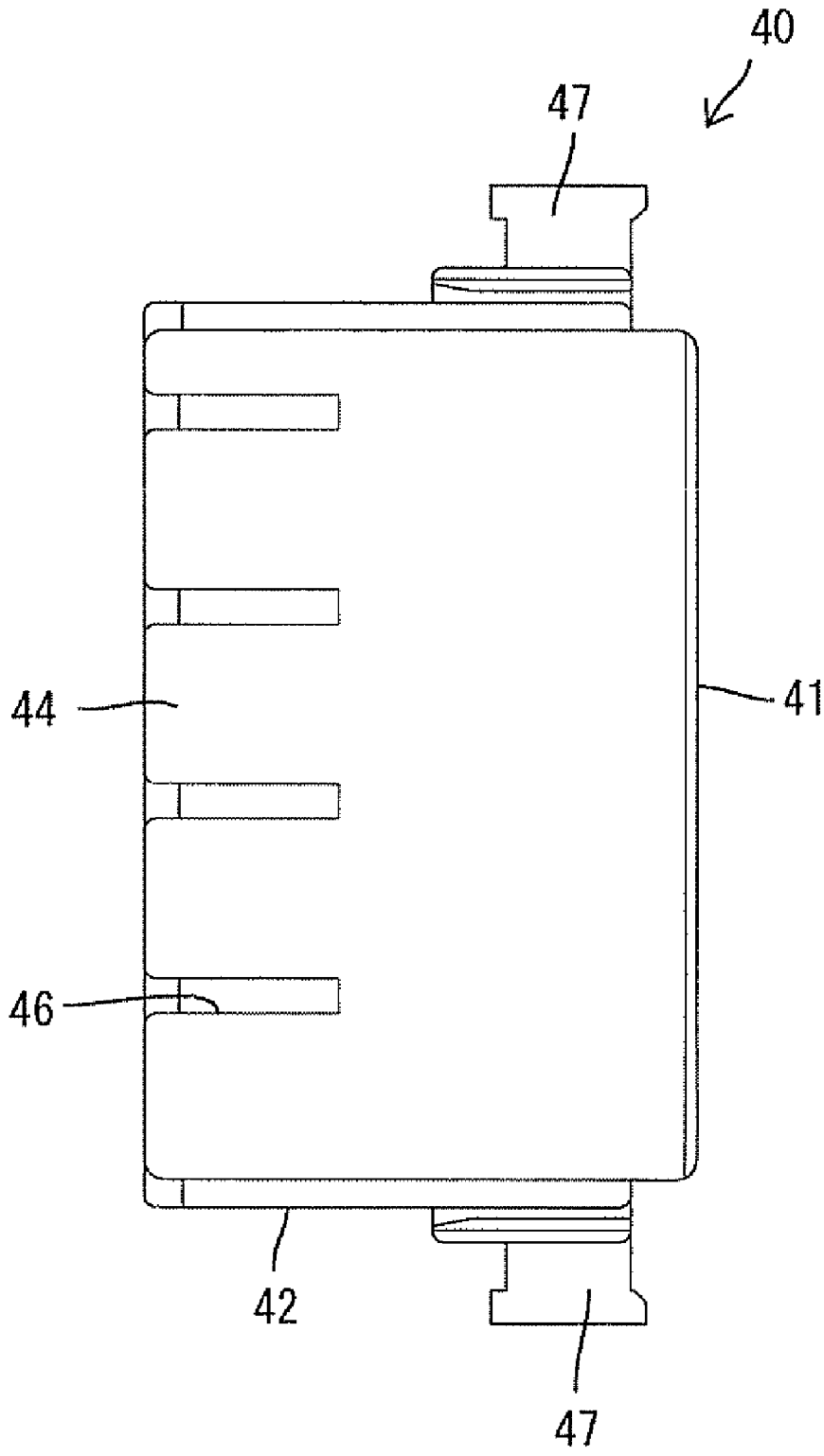
FIG. 8 is a side view of the moving plate.
Figure 9:
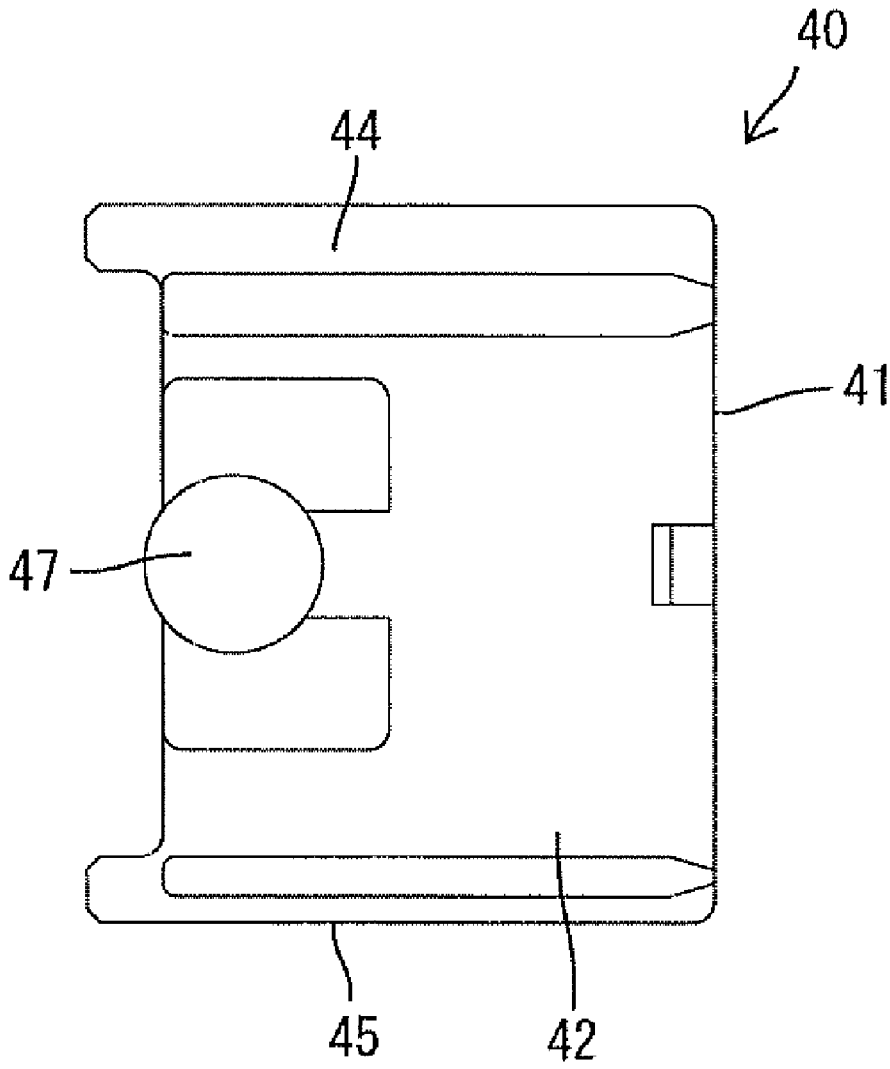
FIG. 9 is a plan view of the moving plate.
Figure 10:
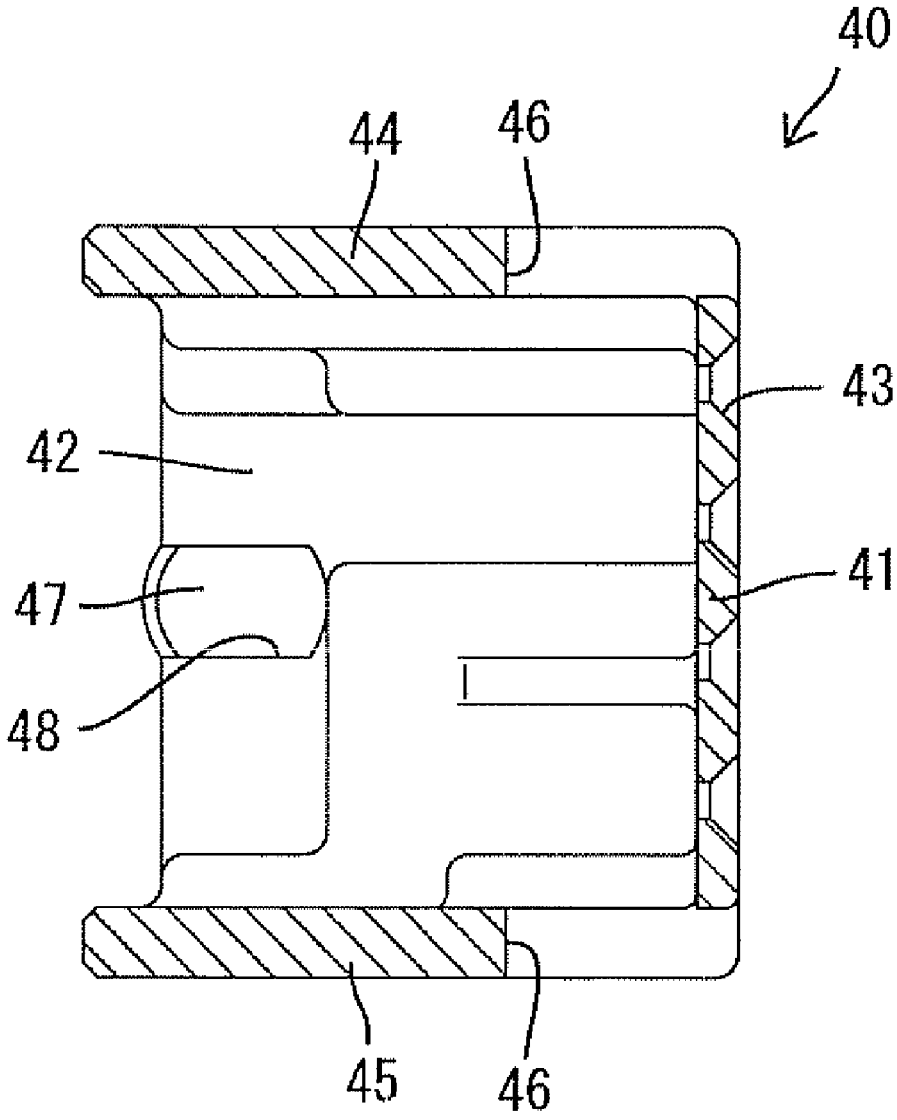
FIG. 10 is a vertical section of the moving plate.

An attempt could be made to insert the female connector 50 inclined with respect to forward and backward directions about a transverse axis into the space surrounded by the surrounding wall 42 of the moving plate 40 while the moving plate 40 is at the advanced position. However, the female connector 50 will contact the upper and lower walls 44, 45, as shown in FIG. 4, and cannot be inserted deeply. Here, the moving plate 40 is at the advanced position and the main body 41 is engaged with the front parts of the third tabs 31C. Thus, the projecting distance of the third tabs 31C from the main body 41 in the space surrounded by the surrounding wall 42 is short. Additionally, the vertical dimension between the upper and lower walls 44, 45 of the space surrounded by the surrounding wall 42 is smaller than twice the depth dimension from the front end of the surrounding wall 42 to the plate main body 41 in forward and backward directions. Therefore, a corner portion of the female connector 50 in an oblique posture at the leading end in the inserting direction of the female connector 50 does not reach the third tabs 31C.

The upper and lower walls 44, 45 may deform and bulge out up or down (see FIG. 1) if a pushing force to insert the female connector 50 is strong. However, the upper and lower walls 44, 45 have the cutouts 46 corresponding to the second tabs 31B. The second tabs 31B enter the cutouts 46 so that the deformed upper and lower walls 44, 45 do not interfere with the second tabs 31B.

An attempt could be made to insert the female connector 50 in an oblique posture into the space above or below the moving plate 40. However, the upper and lower walls 44, 45 restrict an insertable amount of the female connector 50 and there is little likelihood that the corner of the female connector 50 at the leading end in the inserting direction will interfere with the first and second tabs 31A, 31B.

As described above, the surrounding wall 42 projects forward from the main body 41 and surrounds only the third tabs 31C without surrounding the first and second tabs 31A, 31B. Additionally, the surrounding wall 42 crosses the inside of the receptacle 12 and is close to the center of the receptacle 12 instead of extending along the inner peripheral surface of the receptacle 12. Accordingly, even if an attempt is made to insert the female connector 50 in an oblique posture into the receptacle 12, the female connector 50 cannot be inserted deeply into the receptacle 12 due to interference with the surrounding wall 42. Therefore, the tabs 31A, 31B and 31C will not be damaged by the female connector 50.

The lever 20 keeps the moving plate 40 at the advanced position close to the opening of the receptacle 12 unless the female connector 50 is fit in the receptacle 12. Thus, the front end edge of the surrounding wall 42 is more forward than the front ends of the tabs 31A, 31B and 31C and the tabs 31A, 31B and 31C are not likely to be damaged by the interference of the female connector 50.

The female connector 50 is formed with the grooves 52 to avoid interference with the upper and lower walls 44, 45. The moving plate 40 can be moved to the retracted position towards the back side of the receptacle 12 by operating the lever 20 upon fitting the female connector 50 into the receptacle 12. Thus, the depth of the grooves 52 can be decreased as compared to a construction in which a wall projects from the back end surface of a receptacle and is not movable. In this way, a reduction in the rigidity of the female connector 50 resulting from the formation of the groove portions 52 can be suppressed.

There has been a demand in recent years for miniaturization of connectors. With miniaturization, the projecting distances of the tabs 31A, 31B and 31C from the back end surface of the receptacle 12 become shorter and, accordingly, the maximum projecting distance of the third tabs 31C from the main body 41, i.e. the insertion distance of the third tabs 31C into the female connector 50 fit into the receptacle 12 also becomes shorter. This means that the contact dimension of the third female terminal fittings 51C and the third tabs 31C in the female connector 50 becomes shorter. It can be thought to reduce the thickness of the main body 41 to increase the maximum projecting distance of the third tabs 31C from the main body 41 as a countermeasure. The main body 41 becomes weaker and is more easily deformed as it is thinned. The surrounding wall 42 will deform if the main body 41 deform, and forcible contact might occur between the surrounding wall 42 and the receptacle 12.

However, the main body 41 is smaller than the opening area of the receptacle 12. Thus, flexion rigidity is higher and the main body 41 is difficult to deform even if thinned. Accordingly, the main body 41 can be thinned to achieve miniaturization of the moving plate 40 and the entire male connector 10.

The moving plate 40 is in an intermediate position in the vertical direction of the opening of the receptacle 12, and variations in the dimensions of the spaces partitioned by the upper and lower walls 44, 45 in the receptacle 12 become smaller. In other words, the damage of the tabs 31A, 31B and 31C by the female connector 50 can be prevented more reliably since there is no space having an extremely large dimension.

The surrounding wall 42 is substantially parallel with the projecting direction PD of the tabs 31A, 31B and 31C and is arranged in the arranged area of the tabs 31A, 31B and 31C. The upper and lower walls 44, 45 of the surrounding wall 42 are formed with the cutouts 46 corresponding to the second tabs 31B adjacent to the upper and lower walls 44, 45. Thus, even if the upper and lower walls 44, 45 deform to approach the second tabs 31, the second tabs 31B can fit into the cutouts 46. Therefore no pressing forces act on the second tabs 31B from the upper and lower walls 44, 45. Accordingly, the deformation of the second tabs 31B caused by pressing forces from the surrounding wall 42 can be avoided.

The moving plate 40 is at the advanced position without the female connector 50 being fitted in the receptacle 12 and the moving plate 40 is moved towards the retracted position as the female connector 50 is fit. Thus, an attempt to insert the female connector 50 in an oblique posture can be made only when the moving plate 40 is at the advanced position. Accordingly, the formation range of the cutouts 46 is restricted only to a range substantially corresponding to the second tabs 31B with the moving plate 40 at the advanced position. The corresponding area of the second tabs 31B and the upper and lower walls 44, 45 in the projecting direction of the second tabs 31B is shorter when the moving plate 40 is at the advanced position than when the moving plate 40 is at the retracted position. Therefore, the cutouts 46 can have a necessary minimum dimension and, a reduction in the rigidity of the surrounding wall 42 caused by the formation of the cutouts 46 is suppressed.

It can be also thought to form wide cutouts corresponding to a plurality of second tabs 31B. However, since the opening areas of the cutouts are increased in this case, the rigidity of the surrounding wall 42 might be reduced. In that respect, the rigidity reduction of the surrounding wall 42 can be suppressed to a necessary minimum level since the cutouts 46 are slit-shaped.

The invention is not limited to the above described and illustrated embodiment. For example, the following embodiments are also embraced by the technical scope of the present invention as defined by the claims.

The plate-like main body may have substantially the same size as the opening area of the receptacle and all of the plurality of tabs may pass therethrough. In this case, the wall portion projects at a position near the center of the plate-like main body instead of extending along the peripheral edge of the plate-like main body.

Plural moving plates may be provided in one receptacle. In this case, the lever may be provided with a plurality of cam grooves.

The moving plate may be displaced towards one end in the longitudinal direction of the receptacle.

The number of types of tabs to be accommodated in one receptacle is not limited to three, but may be one, two, four or more.

The cutouts may have a wide form as to correspond to a plurality of tabs without being limited to slits.

The cutouts may be recesses formed in the outer surface of the wall portion without being limited to through holes penetrating from the outer circumferential surface to the inner circumferential surface of the wall portion.

The wall portion may be formed with no cutouts.

It should be understood that even though the movable member was described with respect to a rotatable lever, any kind of movable member displaying a cam action may be used according to the invention, such as a slider movable along a substantially linear path or any other path.

It should be understood that the invention is also applicable to cases where only one type of terminal fittings or two, four or more different types of terminal fittings are adopted.

What is claimed is:

1. A connector, comprising:

a housing formed with a receptacle having an open front end for receiving a mating connector;

male terminal fittings having tabs projecting forward into the receptacle and at least partly surrounded by the receptacle; and at least one moving plate movable in the receptacle between a position close to the open front end of the receptacle and a position rearward of the open front end of the receptacle, the moving plate including a main body through which a plurality of the tabs are passed for aligning the tabs and a wall projecting unitarily from the main body and surrounding the tabs that pass through the main body, the main body having only some of the plurality of tabs passed therethrough.

2. The connector of claim 1, wherein the wall is formed along a peripheral edge of the main body.

3. The connector of claim 1, wherein the opening of the receptacle is substantially rectangular.

4. The connector of claim 1, wherein the moving plate is located substantially at a longitudinal center position of the opening of the receptacle.

5. The connector of claim 1, wherein the wall is substantially parallel with a projecting direction of the tabs.

6. The connector of claim 1, wherein the wall is formed with cutouts so that even if the wall portion is curved and deformed, the tabs other than the tabs surrounded by the wall can enter the cutouts.

7. The connector of claim 1, wherein the tabs positioned by the moving plate are smaller than the tabs that are not positioned by the moving plate.

8. The connector of claim 1, further comprising a movable member mounted to the housing for displaying a cam action for connecting the connector with the mating connector and for displacing the moving plate.

9. The connector of claim 8, wherein the main body is smaller than an opening area of the receptacle.

10. A connector, comprising:

a housing formed with a receptacle having an open front end for receiving a mating connector;

male terminal fittings having tabs projecting forward into the receptacle and at least partly surrounded by the receptacle; and at least one moving plate movable in the receptacle between a position close to the open front end of the receptacle and a position rearward of the open front end of the receptacle, the moving plate including a main body through which a plurality of the tabs are passed for aligning the tabs and a wall projecting unitarily from the main body and surrounding the tabs that pass through the main body, wherein the wall divides an internal space of the receptacle into a plurality of spaces.

11. The connector of claim 10, wherein the main body has only some of the plurality of tabs passed therethrough.

12. The connector of claim 10, further comprising a movable member mounted to the housing for displaying a cam action for connecting the connector with the mating connector and for displacing the moving plate.

13. The connector of claim 10, wherein the wall is substantially parallel with a projecting direction of the tabs.

14. The connector of claim 10, wherein the tabs positioned by the moving plate are smaller than the tabs that are not positioned by the moving plate.

* * * * *